US009141125B2

(12) United States Patent
Ding et al.

(10) Patent No.: US 9,141,125 B2
(45) Date of Patent: Sep. 22, 2015

(54) BANDGAP REFERENCE VOLTAGE GENERATING CIRCUIT AND ELECTRONIC SYSTEM USING THE SAME

(71) Applicant: ADVANCED SEMICONDUCTOR ENGINEERING INC., Kaohsiung (TW)

(72) Inventors: Jaw-Ming Ding, Taoyuan County (TW); Hsin-Chin Chang, Taipei (TW)

(73) Assignee: Advanced Semiconductor Engineering Inc., Kaohsiung (TW)

( * ) Notice: Subject to any disclaimer, the term of this patent is extended or adjusted under 35 U.S.C. 154(b) by 109 days.

(21) Appl. No.: 14/016,432

(22) Filed: Sep. 3, 2013

(65) Prior Publication Data

US 2014/0354259 A1 Dec. 4, 2014

(30) Foreign Application Priority Data

Jun. 3, 2013 (TW) ..... 102119577 A

(51) Int. Cl.
*G05F 3/30* (2006.01)
*G05F 1/567* (2006.01)

(52) U.S. Cl.
CPC ..... *G05F 3/30* (2013.01)

(58) Field of Classification Search
CPC ..... G05F 3/16; G05F 3/24; G05F 3/242; G05F 3/245; G05F 3/30; G05F 1/567
USPC ..... 323/273, 277, 311–317, 907; 327/539
See application file for complete search history.

(56) References Cited

U.S. PATENT DOCUMENTS

| | | | | |
|---|---|---|---|---|
| 5,686,824 | A * | 11/1997 | Rapp | 323/313 |
| 6,987,416 | B2 | 1/2006 | Ker et al. | |
| 7,208,930 | B1 * | 4/2007 | Tran et al. | 323/314 |
| 7,629,785 | B1 | 12/2009 | Drebinger | |
| 7,688,054 | B2 * | 3/2010 | Cave | 323/313 |
| 7,728,575 | B1 * | 6/2010 | Ozalevli et al. | 323/313 |
| 8,791,685 | B2 * | 7/2014 | Cho et al. | 323/314 |
| 9,046,910 | B2 * | 6/2015 | Sako et al. | 1/1 |

FOREIGN PATENT DOCUMENTS

| | | | |
|---|---|---|---|
| CN | 101609344 | A | 12/2009 |
| CN | 101950191 | A | 1/2011 |
| CN | 102279611 | A | 12/2011 |

(Continued)

*Primary Examiner* — Gary L Laxton
(74) *Attorney, Agent, or Firm* — Foley & Lardner LLP; Cliff Z. Liu; Angela D. Murch

(57) ABSTRACT

A bandgap reference voltage generating circuit for providing a reference voltage is disclosed. The bandgap reference voltage generating circuit includes four-terminal current source circuit, a regulator circuit and a temperature-compensating circuit. The four-terminal current source circuit outputs a first voltage, a second voltage and a first current which are independent of variation of a first system voltage. The regulator circuit receives the first voltage and the second voltage and when the first system voltage is larger than a threshold voltage value, the regulator circuit outputs the reference voltage independent of variation of the first system voltage via voltage-difference between the first voltage and the second voltage. The temperature-compensating circuit receives the first current and compensates a temperature curve of the reference voltage outputted from the regulator circuit.

13 Claims, 14 Drawing Sheets

(56) References Cited

FOREIGN PATENT DOCUMENTS

| | | | |
|---|---|---|---|
| CN | 102393786 | A | 3/2012 |
| CN | 102591398 | A | 7/2012 |
| CN | 103116381 | A | 5/2013 |
| EP | 0 930 619 | A2 | 7/1999 |
| TW | 200944989 | A | 11/2009 |

* cited by examiner

BANDGAP REFERENCE VOLTAGE GENERATING CIRCUIT AND ELECTRONIC SYSTEM USING THE SAME

BACKGROUND OF THE INVENTION

1. Field of the Invention

The instant disclosure relates to a bandgap reference voltage generating circuit; in particular, to the bandgap reference voltage generating circuit independent of system voltage and temperature.

2. Description of Related Art

With continuous inventions and improvements in high technology, consumer electronic products are gradually becoming commonly used in daily lives of people, especially various types of electronic devices such as: cell phones, digital cameras, personal digital assistants (PDA), and Tablet PCs; the consumer electronic products are popular for their features of thinness, smallness, and portability. However, when using the portable electronic devices, there is a problem of the time durance of power supply; as for now, the common solution is to mix using Ni-MH batteries or Lithium batteries with extra respectively matched chargers.

In prior art, design for bandgap reference voltage source circuit is well known in the field, these circuits are designed to provide a voltage standard independent of temperature change. The reference voltage of the bandgap reference voltage source circuit is a function of voltage Vbe developed by base-emitter voltage of the BJT and voltage difference ΔVbe developed by difference between base-emitter voltage of another two BJTs. Base-emitter voltage Vbe of the first BJT is voltage with negative temperature coefficient; which means, when temperature increases, the base-emitter voltage Vbe decreases. Voltage difference ΔVbe of another two BJTs is a voltage with positive temperature coefficient; which means, when temperature increases, the voltage difference ΔVbe increases with that. The reference voltage independent of temperature of the bandgap reference voltage source circuit may be adjusted via adjusting a sum of the voltage difference ΔVbe and the base-emitter voltage Vbe. However, General reference voltage generating circuit typically may experience a change in the ambient temperature or variation of the system voltage so as to generate the related problems of affecting the stability of the reference voltage.

SUMMARY OF THE INVENTION

The instant disclosure provides a bandgap reference voltage generating circuit used for providing a reference voltage, the bandgap reference voltage generating circuit comprises a four-terminal current source circuit, a regulator circuit and a temperature-compensating circuit. The four-terminal current source circuit is electrically connected a first system voltage, wherein when the first system voltage is larger than a threshold voltage value, a first voltage, a second voltage and a first current outputted from the four-terminal current source circuit are independent of variation of the first system voltage. The regulator circuit is electrically connected to the four-terminal current source circuit, wherein when the regulator circuit receives the first voltage and the second voltage and when the first system voltage is larger than the threshold voltage value, the reference voltage outputted from the regulator circuit is independent of variation of the first system voltage via voltage difference between the first voltage and the second voltage. The temperature-compensating circuit is electrically connected to the four-terminal current source circuit and the regulator circuit, wherein the temperature-compensating circuit receives the first current and compensates temperature curve of the reference voltage outputted from the regulator circuit.

In an embodiment of the instant disclosure, wherein temperature curve of the reference voltage outputted from the regulator circuit is compensated, so that temperature curve of the reference voltage is compensated from second-order temperature curve to third-order temperature curve.

In an embodiment of the instant disclosure, wherein when the first system voltage is larger than the threshold voltage value, the four-terminal current source circuit outputs the first voltage and the second voltage steady and outputs the first current steady.

In an embodiment of the instant disclosure, the four-terminal current source circuit comprises a first transistor, a second transistor and a first resistor. The first transistor has a drain connected to the first system voltage. Drain of the second transistor is connected to a source of the first transistor, and a source of the second transistor is connected to a gate of the first transistor, wherein the first transistor and the second transistor are depletion mode transistor. One terminal of the first resistor is connected to the source of the second transistor, and another terminal of the first resistor is connected to the gate of the second transistor, wherein when the first system voltage is larger than the threshold voltage value, the first current generated from the first transistor, the second transistor and the first resistor is steady current independent of variation of the first system voltage.

In an embodiment of the instant disclosure, the regulator circuit comprises a third transistor and a fourth transistor. Drain of the third transistor is connected to the first system voltage, and gate of the third transistor is connected to gate of the first transistor for receiving the first voltage. Drain of the fourth transistor is connected a source of the third transistor, gate of the fourth transistor is connected to another terminal of the first resistor for receiving the second voltage, and source of the fourth transistor is connected to a loading resistor and outputs the reference voltage, wherein the third transistor and the fourth transistor are depletion mode transistor. A source voltage of the third transistor is stabilized via the stable first voltage, so that the reference voltage is independent of variation of the first system voltage and be locked in a first reference voltage value.

In an embodiment of the instant disclosure, the regulator circuit comprises a fifth transistor and a sixth transistor. Drain of the fifth transistor is connected to the first system voltage, and gate of the fifth transistor connected to source of the first transistor for receiving the first voltage. Drain of the sixth transistor is connected to a source of the fifth transistor, a gate of the sixth transistor is connected to the gate of the first transistor for receiving the second voltage, and a source of the sixth transistor is connected to a loading resistor and outputs the reference voltage. The fifth transistor and the sixth transistor are depletion mode transistor and source voltage of the fifth transistor is locked at steady voltage value via the first voltage steadily, so that the reference voltage is independent of variation of the first system voltage and is locked at a first reference voltage value.

In an embodiment of the instant disclosure, the temperature-compensating circuit comprises a first bipolar transistor, a second resistor, a third resistor, a fourth resistor, a fifth resistor, a second bipolar transistor, a sixth resistor and a third bipolar transistor. Emitter of the first bipolar transistor is connected to a ground voltage. One terminal of the second resistor is connected to a base of the first bipolar transistor. One terminal of the third resistor is connected to another terminal of the second resistor, and another terminal of the third resistor is connected to collector of the first bipolar transistor. One terminal of the fourth resistor is connected to one terminal of the third resistor. One terminal of the fifth resistor is connected to another terminal of the fourth resistor and connected to the source of the fourth transistor or the sixth transistor. Base of the second bipolar transistor is connected to another terminal of the third resistor, and collector of the second bipolar transistor is connected to another terminal of the fifth resistor. One terminal of the sixth resistor is connected to emitter of the second bipolar transistor, and another terminal of the sixth resistor is connected to the ground voltage. A second current flowing through the sixth resistor is a current with positive temperature coefficient via a base-emitter voltage difference between a first base-emitter voltage of the first bipolar transistor and a second base-emitter voltage of the second bipolar transistor. Base of the third bipolar transistor is connected to a collector of the second bipolar transistor, emitter of the third bipolar transistor is connected to the ground voltage, and collector of the third bipolar transistor is connected to another terminal of the first resistor, wherein the third bipolar transistor has a third base-emitter voltage with negative temperature coefficient and the reference voltage is equal to or close to a voltage with zero temperature coefficient via adjustment of resistor value of the fifth resistor and the sixth resistor, and the first reference voltage value is equal to a sum of a voltage-drop of the fifth resistor and the third base-emitter voltage.

In an embodiment of the instant disclosure, wherein the temperature curve of the reference voltage is compensated from second-order temperature curve to third-order temperature curve via adjustment of resistor value of the second resistor and the third resistor.

In an embodiment of the instant disclosure, the temperature-compensating circuit further comprises a seventh resistor. One terminal of the seventh resistor is connected to base of the third bipolar transistor, and another terminal of the seventh resistor is connected to the ground voltage, wherein the seventh resistor is configured for increasing the first reference voltage value of the reference voltage to the second reference voltage value, and the second reference voltage value of the reference voltage is equal to a sum of voltage-drop of the fifth resistor and voltage-drop of the seventh resistor.

From another point of view, the instant disclosure provides an electronic system. The electronic system comprises a bandgap reference voltage generating circuit and a load. The bandgap reference voltage generating circuit comprises a four-terminal current source circuit, a regulator circuit and a temperature-compensating circuit. The four-terminal current source circuit is electrically connected to a first system voltage, wherein when the first system voltage is larger than a threshold voltage value, a first voltage, a second voltage and a first current outputted from the four-terminal current source circuit are independent of variation of the first system voltage. The regulator circuit is electrically connected to the four-terminal current source circuit, wherein when the regulator circuit receives the first voltage and the second voltage, and when the first system voltage is larger than the threshold voltage value, the reference voltage outputted from the regulator circuit is independent of variation of the first system voltage via voltage difference between the first voltage and the second voltage. The temperature-compensating circuit is electrically connected to the four-terminal current source circuit and the regulator circuit, wherein the temperature-compensating circuit receives the first current and compensates temperature curve of the reference voltage outputted from the regulator circuit. A load is electrically connected to the bandgap reference voltage generating circuit for receiving the reference voltage.

In summary, the bandgap reference voltage generating circuit and the electronic system provided by the instant disclosure is able to provide the reference voltage independent of the first system voltage and temperature, via the four-terminal current source circuit and the temperature-compensating circuit.

For further understanding of the instant disclosure, reference is made to the following detailed description illustrating the embodiments and examples of the instant disclosure. The description is only for illustrating the instant disclosure, not for limiting the scope of the claim.

BRIEF DESCRIPTION OF THE DRAWINGS

Embodiments are illustrated by way of example and not by way of limitation in the figures of the accompanying drawings, in which like references indicate similar elements and in which.

DETAILED DESCRIPTION OF PREFERRED EMBODIMENTS

Figure 1:
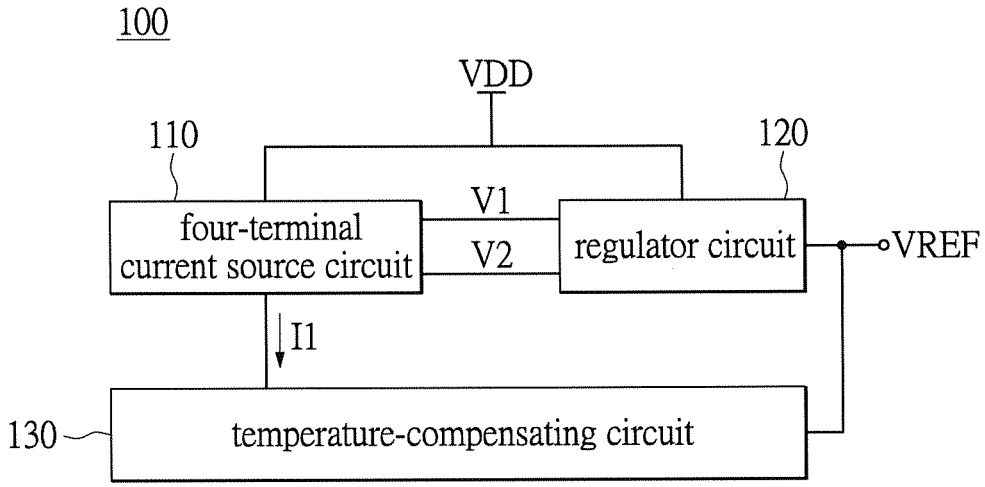
FIG. 1 shows block schematic diagram of the bandgap reference voltage generating circuit according to one embodiment of the instant disclosure.

The aforementioned illustrations and following detailed descriptions are exemplary for the purpose of further explaining the scope of the instant disclosure. Other objectives and advantages related to the instant disclosure will be illustrated in the subsequent descriptions and appended drawings. In the drawings, the size and relative sizes of layers and regions may be exaggerated for clarity.

It will be understood that, although the terms first, second, third, and the like, may be used herein to describe various elements, components, regions, layers and/or sections, these elements, components, regions, layers and/or sections should not be limited by these terms. These terms are only to distinguish one element, component, region, layer or section from another region, layer or section discussed below could be termed a second element, component, region, layer or section without departing from the teachings of the present disclosure. As used herein, the term "and/or" includes any and all combinations of one or more of the associated listed items.

[One Embodiment of the Bandgap Reference Voltage Generating Circuit]

Referring to FIG. 1, FIG. 1 shows block schematic diagram of the bandgap reference voltage generating circuit according to one embodiment of the instant disclosure. In the present embodiment, the bandgap reference voltage generating circuit 100 is configured for providing a reference voltage VREF to a next-stage circuit or a load. The bandgap reference voltage generating circuit 100 comprises a four-terminal current source circuit 110, a regulator circuit 120 and a temperature-compensating circuit 130. The four-terminal current source circuit 110 is electrically connected to a first system voltage VDD. The regulator circuit 120 is electrically connected to the four-terminal current source circuit 110 and the first system voltage VDD. The temperature-compensating circuit 130 is electrically connected to the four-terminal current source circuit 110 and the regulator circuit 120. It is to be noted that, the first system voltage VDD of the embodiment is a battery voltage, but it is not restricted thereto. Moreover, in prior art, taking an phone system of third generation (3G) or fourth generation (4G) as an example, the phone system of 3G or 4G has extremely demand for accuracy of the RF output power. Because voltage value of the battery voltage may be change extremely, form 3.2 volt to 4.2 volt, accuracy of the output power of the RF power amplifier will be affected.

Through the bandgap reference voltage generating circuit 100 of instant disclosure, when the first system voltage VDD (i.e. the battery voltage) is larger than a threshold voltage value, the four-terminal current source circuit 110 may output a first current I1, which is steady and independent of variation of the first system voltage VDD, to the temperature-compensating circuit 130 and outputs a first voltage V1 and a second voltage V2, which are independent of variation of the first system voltage VDD, to the regulator circuit 120. Next, when the first system voltage VDD is larger than a threshold voltage value, the regulator circuit 120 receives the first voltage V1 and the second voltage V2 and outputs the reference voltage VREF independent of variation of the first system voltage VDD via a steady voltage difference between the first voltage V1 and the second voltage V2. Furthermore, the first voltage V1 stable and the second voltage V2 outputted from the four-terminal current source circuit 110 is used for driving the regulator circuit 120, and the first voltage V1 and the second voltage V2 may further be locked by the regulator circuit 120. From another point of view, in the case of the first system voltage VDD being larger than threshold voltage value, the four-terminal current source circuit 110 generates the first current I1 steady in the instant disclosure, so that the voltage difference between the first voltage V1 and the second voltage V2 will be stabilized. It is worth mentioned that the threshold voltage value is a voltage value between 2.5 volt and 3.2 volt, and its actual value may be designed by a designer according to circuit design or actual application demand.

For example, in an exemplary embodiment, the threshold voltage value is 1.8 volt; which means, the four-terminal current source circuit 110 outputs the first current I1 steady when the first system voltage VDD is between 1.8 volt and 4.2 volt, and then the first current I1 steady may stabilize the voltage difference between the first voltage V1 and the second voltage V2, so that the regulator circuit 120 driving by the first voltage V1 and the second voltage V2 is able to output the reference voltage VREF steady (e.g. 1.48 volt) when the first system voltage VDD is between 1.8 volt and 4.2 volt.

In the aspect of the temperature compensation effect, the temperature-compensating circuit 130 is biased or is driven by the first current I1 steady served as a current source, so as to compensate temperature curve of the reference voltage VREF outputted from the regulator circuit 120; which means, the temperature coefficient of the reference voltage is equal to or close to zero temperature coefficient. Furthermore, in the present embodiment, the temperature-compensating circuit 130 compensates temperature curve of the reference voltage VREF from second-order temperature curve to third-order temperature curve, so that the bandgap reference voltage generating circuit 100 of the instant disclosure has a good effect of temperature compensation.

For a specific instruction on an operation process of the bandgap reference voltage generating circuit 100 of the instant disclosure, there is at least one of the embodiments for further instruction.

In the following embodiments, there are only parts different from embodiments in FIG. 1 described, and the omitted parts are indicated to be identical to the embodiments in FIG. 1. In addition, for an easy instruction, similar reference numbers or symbols refer to elements alike.

[Another Embodiment of the Bandgap Reference Voltage Generating Circuit]

Figure 2:
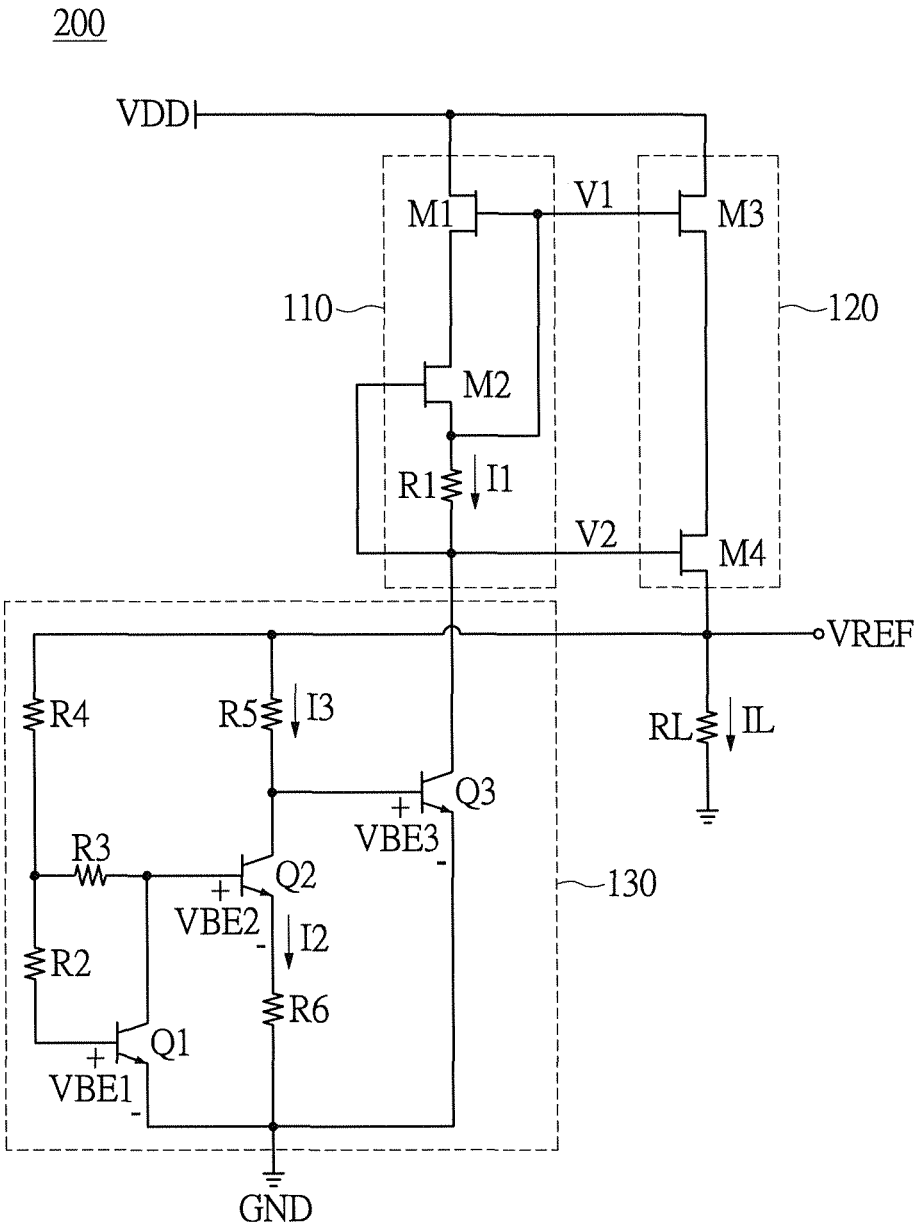
FIG. 2 shows detailed circuit diagram of the bandgap reference voltage generating circuit according to one embodiment of the instant disclosure.

Referring to FIG. 2, FIG. 2 shows detailed circuit diagram of the bandgap reference voltage generating circuit according to one embodiment of the instant disclosure. The difference from the embodiment in FIG. 1 is that, the four-terminal current source circuit 110 comprises a first transistor M1, a second transistor M2 and a first resistor R1. The regulator circuit 120 comprises a third transistor M3 and a fourth transistor M4. The temperature-compensating circuit 130 comprises a first bipolar transistor Q1, a second bipolar transistor Q2, a third bipolar transistor Q3, a second resistor R2, a third resistor R3, a fourth resistor R4, a fifth resistor R5 and a sixth resistor R6, an emitter area of the second bipolar transistor Q2 is larger than an emitter area of the first bipolar transistor Q1. Drain of the first transistor M1 is connected to first system voltage VDD. Drain of the second transistor M2 is connected to source of the first transistor M1, and source of the second transistor M2 is connected to gate of the first transistor M1, wherein the first transistor M1 and the second transistor M2 are depletion mode transistors. One terminal of the first resistor R1 is connected to source of the second transistor M2, and another terminal of the first resistor R1 is connected to gate of the second transistor M2. Drain of the third transistor M3 is connected to first system voltage VDD, gate of the third transistor M3 is connected to the gate of the first transistor M1 for receiving the first voltage V1. Drain of the fourth transistor M4 is connected to source of the third transistor M3, gate of the fourth transistor M4 is connected to another terminal of the first resistor R1 for receiving the second voltage V2, and source of the fourth transistor M4 is connected to the loading resistor RL and outputs the reference voltage VREF, the third transistor M3 and the fourth transistor M4 are depletion mode transistors. Emitter of the first bipolar transistor Q1 is connected to the ground voltage GND. One terminal of the second resistor R2 is connected to base of the first bipolar transistor Q1. One terminal of the third resistor R3 is connected to another terminal of the second resistor R2, and another terminal of the third resistor R3 is connected to collector of the first bipolar transistor Q1. One terminal of the fourth resistor R4 is connected to one terminal of the third resistor R3. One terminal of the fifth resistor R5 is connected to another terminal of the fourth resistor R4 and the fourth transistor M4. Base of the second bipolar transistor Q2 is connected to another terminal of the third resistor R3, collector of the second bipolar transistor Q2 is connected to another terminal of the fifth resistor R5. One terminal of the sixth resistor R6 is connected to emitter of the second bipolar transistor Q2, and another terminal of the sixth resistor R6 is connected to the ground voltage.

Before further instruction, it is to be clarified that in the instant disclosure, the positive temperature coefficient indicates that there is a proportional relationship between physical quantities (such as a voltage value, a current value, and a resistor value) and the temperature; which means, when the temperature increases or decreases, the physical quantities increases or decreases with the temperature; the negative temperature coefficient indicates that there is an inverse relationship between the physical quantities and the temperature; which means, when the temperature increases or decreases, the physical quantities decreases or increases with the temperature. The zero temperature coefficient in the instant disclosure indicates that the relationship between the physical quantities (such as the voltage value, the current value, and the resistor value) and the temperature is irrelevant, which means, when the temperature increases or decreases, the physical quantities do not increase or decrease with the temperature.

The related operation of the bandgap reference voltage generating circuit 200 is further described in the following paragraphs, for better understanding of the instant disclosure.

When the bandgap reference voltage generating circuit 200 faces the change of the first system voltage VDD (i.e. the battery voltage), the instant disclosure may provide the first current I1 steady via the first transistor M1, the second transistor M2 and the first resistor R1. Furthermore, when the first system voltage VDD is larger than the threshold voltage value (e.g. 1.8 volt), voltage of gate and source for the first transistor M1 may respectively be maintained at a voltage value and voltage of gate and source for the second transistor M2 also may be respectively maintained at a voltage value steadily, and then the first current I1 may be generated via the first resistor R1. Because one terminal of the first resistor R1 is connected to source of the second transistor M2 and another terminal of the first resistor R1 is connected to gate of the second transistor M2, a voltage difference across two-terminal of the first resistor R1 may be maintained at voltage value steadily, and then stabilize the first current I1 In the present embodiment, gate voltage of the first transistor M1 is served as the first voltage V1, gate voltage of the second transistor M2 is served as the second voltage V2, and then the regulator circuit 120 is biased or driven by the first voltage V1 and the second voltage V2. Furthermore, because gate of the third transistor M3 receives the first voltage V1 and the third transistor M3 is depletion mode transistor, so that source voltage of the third transistor Q3 is locked at voltage value steadily via the stable first voltage V1 and then the reference voltage VREF independent of change of the first system voltage VDD is locked at the first reference voltage value, wherein the first reference voltage value is equal to a sum of voltage-drop of the fifth resistor R5 and the third base-emitter voltage VBE3. For example, in the present embodiment, source-gate voltage of the third transistor M3 is 1 volt, source voltage of the third transistor M3 is larger than the first voltage V1 (about 1 volt), and then source voltage of the third transistor M3 may be locked at a sum of voltage value of the first voltage V1 and 1 volt, wherein drain voltage of the fourth transistor M4 is equal to source voltage of the third transistor M3. Next, because gate voltage and drain voltage of the fourth transistor M4 may be locked, source voltage of the fourth transistor M4 (i.e. the reference voltage VREF) may also be locked at a fixed voltage value. From another point of view, the regulator circuit 120 is consisted of cascoded depletion mode transistor, and accordingly the regulator circuit 120 provides the reference voltage VREF which is stable and independent of change of the battery voltage. It is worth mentioned that, in the present embodiment, the transistor M1~M4 are Pseudomorphic heterostructure FET (PHEMT).

In the aspect of the temperature compensation effect, in the present embodiment, the temperature-compensating circuit 130 comprises a first bipolar transistor Q1, a second bipolar transistor Q2, a third bipolar transistor Q3, a second resistor R2, a third resistor R3, a fourth resistor R4, a fifth resistor R5 a sixth resistor R6, wherein bipolar transistor Q1~Q3 are Heterojunction Bipolar Transistor (HBT) and respectively has base-emitter voltage VBE1, VBE2 and VBE3 with negative temperature coefficient. As shown in FIG. 2, voltage difference across two-terminal of the sixth resistor R6 is a base-emitter voltage difference ΔVbe between a first base-emitter voltage VBE1 of the first bipolar transistor Q1 and a second base-emitter voltage VBE2 of the second bipolar transistor VBE2, as shown in equation (1). Herein, it is to be clarified that it is assumed to ignore effect of the second resistor R2 and the third resistor R3 so as to get the equation (1), and the base-emitter voltage difference ΔVbe is a voltage with negative temperature coefficient. Next, the present embodiment makes the second current I2 flowing through the sixth resistor R6 be a current with positive temperature coefficient via the sixth resistor R6 and the base-emitter voltage difference ΔVbe. Afterwards, if it ignores effect of base current of the second transistor Q2 and the third transistor Q3, the third current I3 flowing through the fifth resistor R5 is equal to the second current I2 and the third current I3 similarly has feature of positive temperature coefficient. By the Kirchhoff's voltage law (KVL), the reference voltage VREF is a sum of the voltage-drop of the fifth resistor R5 and base-emitter voltage VBE3 of the third transistor Q3. As shown in equation (2), in one embodiment, the reference voltage value is 1.48 volt. Therefore, the reference voltage VREF may show a characteristic equal to or close to zero temperature coefficient in face of ambient temperature change via adjustment or design of resistor value of the fifth resistor R5 and the sixth resistor R6. It is worth mentioned that, in the instant disclosure, temperature curve of the reference voltage is compensated from second-order temperature curve to third-order temperature curve via adjustment of the resistor value $$\Delta VBE = VBE1 - VBE2 \quad (1)$$

$$= (R5/R6) \times \Delta VBE + VBE3 \quad (2)$$

Accordingly, when the bandgap reference voltage generating circuit 200 faces change of the battery voltage (i.e. voltage value of the battery voltage) and ambient temperature (i.e. minus 55 degrees Celsius to 125 degrees Celsius), the bandgap reference voltage generating circuit 200 is able to provide the stable reference voltage VREF independent of the battery voltage and ambient temperature (i.e. two variables).

Figure 3:
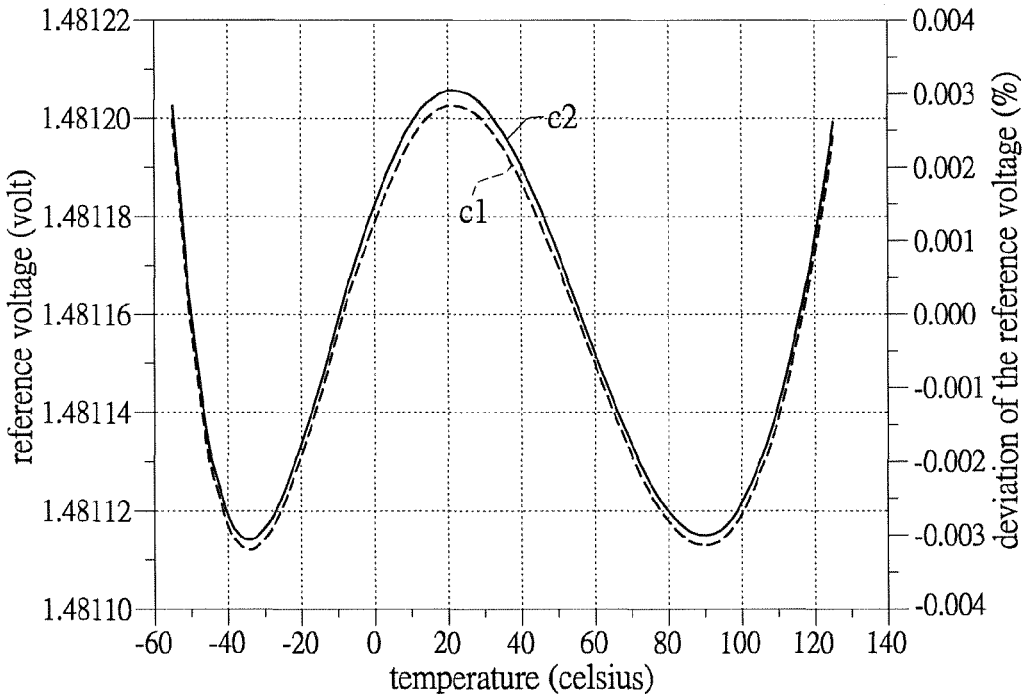
FIG. 3 shows a curve view of temperature compensation effect for the bandgap reference voltage generating circuit according to one embodiment of the instant disclosure.
Figure 4:
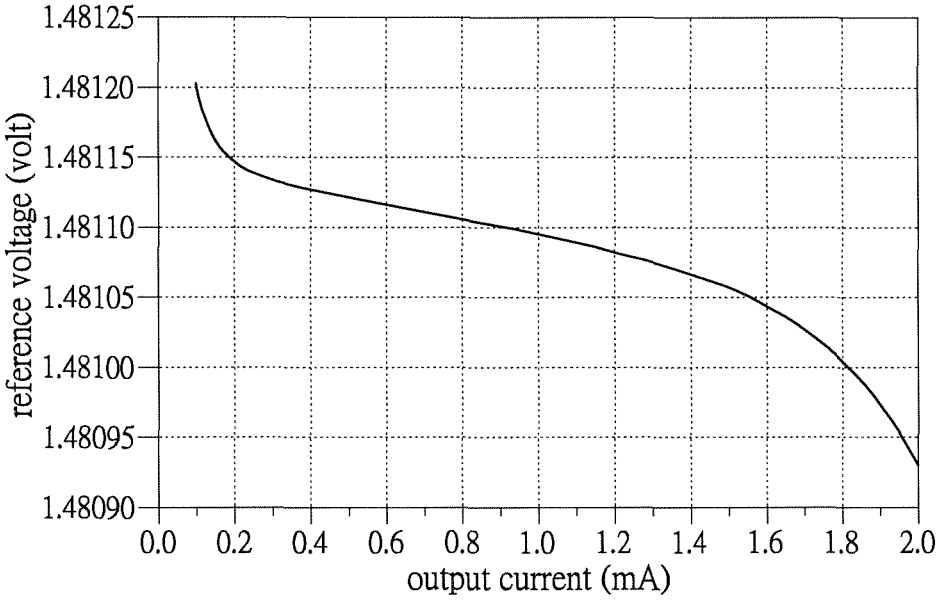
FIG. 4 shows a curve view of the reference voltage relative to the output current according to one embodiment of the instant disclosure.
Figure 5:
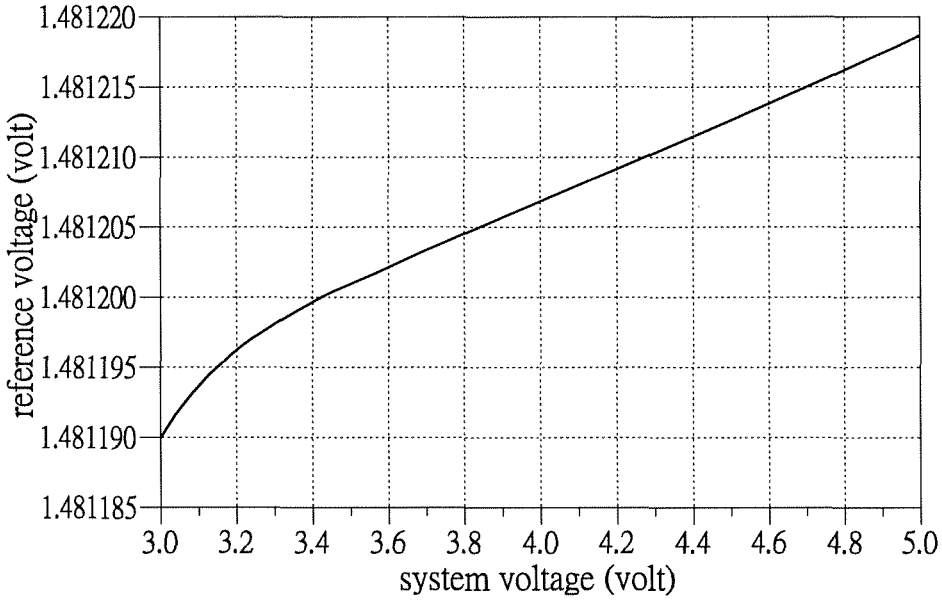
FIG. 5 shows a curve view of the reference voltage relative to the system voltage according to one embodiment of the instant disclosure.
Figure 6:
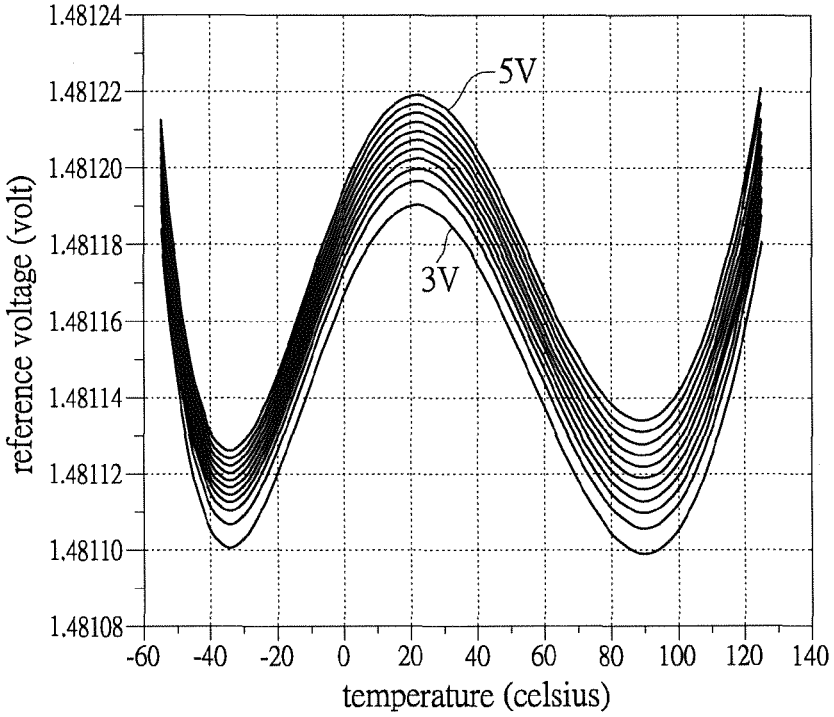
FIG. 6 shows simulation diagram of curve family of the reference voltage relative to temperature according to embodiment of instant disclosure.
Figure 7:
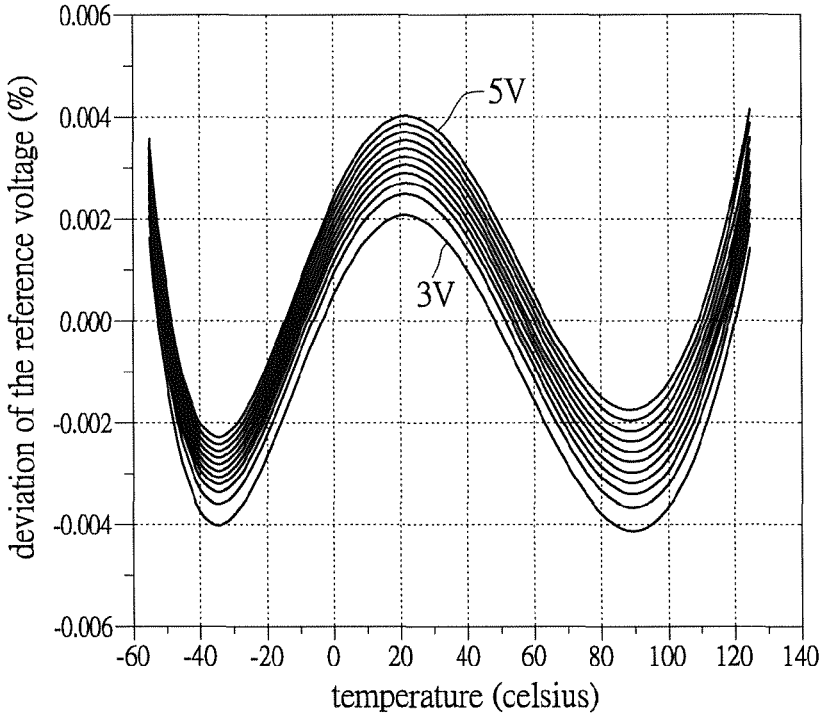
FIG. 7 shows simulation diagram of curve family of deviation of the reference voltage relative to temperature according to embodiment of instant disclosure.
Figure 8:
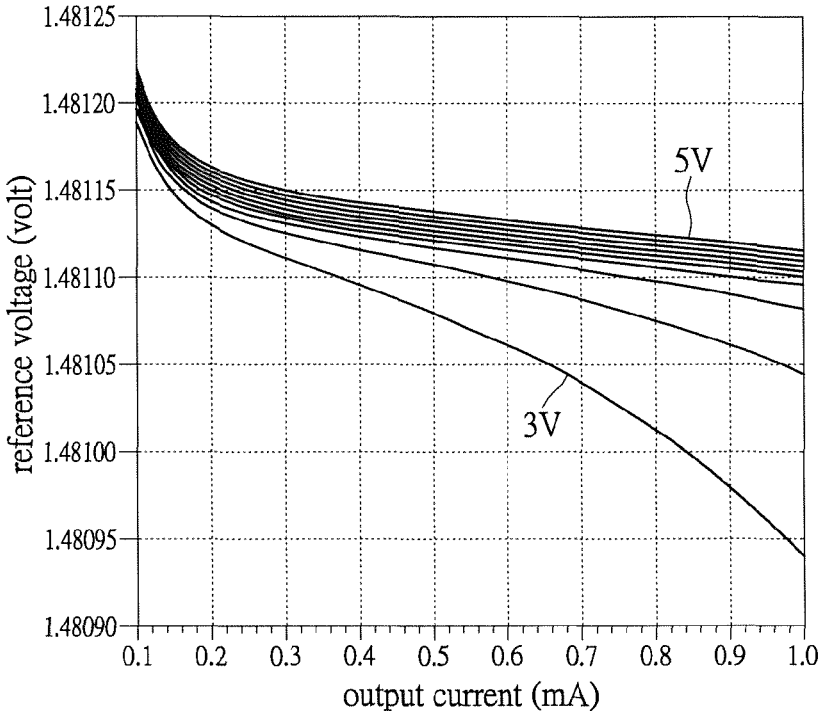
FIG. 8 shows simulation diagram of curve family of the reference voltage relative to output current according to embodiment of instant disclosure.
Figure 9:
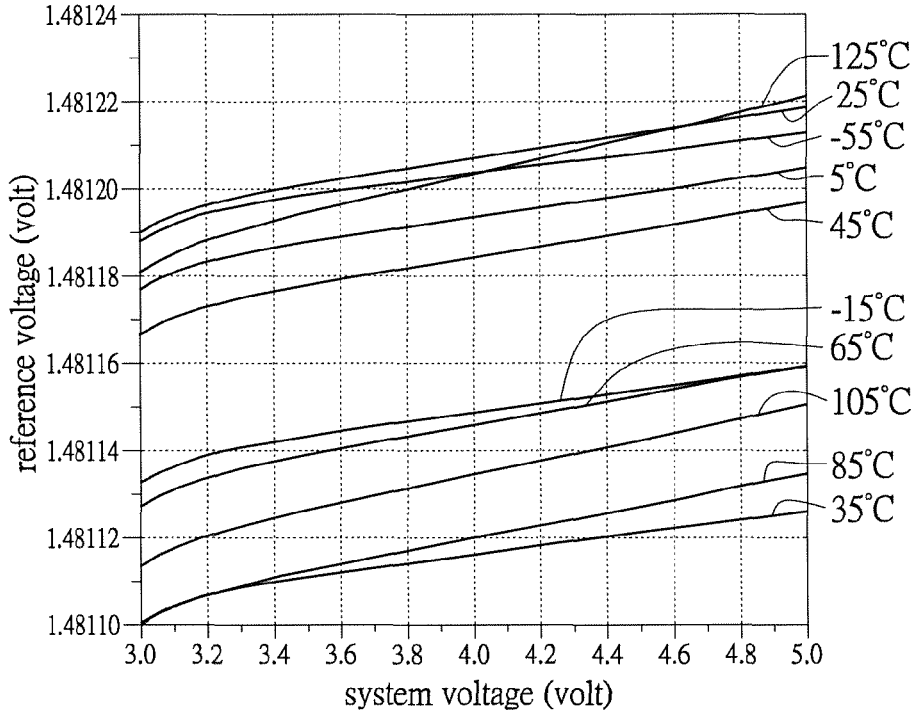
FIG. 9 shows simulation diagram of curve family of the reference voltage relative to system voltage according to embodiment of instant disclosure.

Referring to FIGS. 2 and 3 concurrently, FIG. 3 shows a curve view of temperature compensation effect for the bandgap reference voltage generating circuit according to one embodiment of the instant disclosure. In FIG. 3, the horizontal axis represents the temperature (in ° C.), the left vertical axis represents the reference voltage (volts), right vertical axis represents deviation of the reference voltage (in percentage %), the curve c1 represents the reference voltage, and the curve c2 represents deviation of the reference voltage. FIG. 3 shows that the curve c1 and c2 are third-order temperature curve (through adjusting the first resistor R1, the second resistor R2 and the third resistor R3), and then voltage value of the reference voltage VREF is maintained at 1.481 volt and deviation of the reference voltage VREF is very small (smaller than ±0.003%). Referring to FIGS. 2 and 3 concurrently, FIG. 4 shows a curve view of the reference voltage relative to the output current according to one embodiment of the instant disclosure. In FIG. 4, the horizontal axis represents the output current IL (in units of mA), the vertical axis represents the reference voltage (in volts), wherein an output resistance is less than 0.2 ohms. FIG. 4 shows that, under the case of different loading resistance RL corresponding to the different output current IL, the reference voltage still may be maintained at stable voltage value (about 1.48 volt), therefore a load regulation is about 0.02%. Referring to FIGS. 2 and 5, FIG. 5 shows a curve view of the reference voltage relative to the system voltage according to one embodiment of the instant disclosure. In FIG. 5, the horizontal axis represents the system voltage (in volts), the vertical axis represents the reference voltage (in volts), and FIG. 5 shows that the reference voltage VREF may still be maintained at a fixed voltage value (i.e. 1.48 volt) while system voltage VDD is from 3.0 to 5.0 volt. It is to be noted that, Power Supply Rejection Ratio (PSRR) of the bandgap reference voltage generating circuit 200 in the instant disclosure is about 96 dB, and Line Regulation is about 0.002%. Accordingly, Referring to FIGS. 3 to 5, when the reference voltage VREF faces change of ambient temperature, the loading resistor RL and the first system voltage VDD, the reference voltage VREF may be maintained at fixed voltage value (i.e. 1.48 volt) through operation mechanism of instant disclosure, wherein change of the loading resistor RL is corresponding to change of the output current IL. Afterwards, the follows is to provide other simulations of curve family to better understand the effect of the present embodiment. Referring to FIGS. 6 to 9, FIG. 6 shows simulation diagram of curve family of the reference voltage relative to temperature according to embodiment of instant disclosure, and FIG. 6 is simulation diagram of the reference voltage relative to temperature through scanning of the first system voltage VDD from 3 volt to 5 volt. FIG. 7 shows simulation diagram of curve family of deviation of the reference voltage relative to temperature according to embodiment of instant disclosure. FIGS. 6 and 7 show that, compared to change of the ambient temperature and the system voltage VDD (battery voltage), the reference voltage VREF generated from the bandgap reference voltage generating circuit 200 may be maintained at 1.48 volt stably (the deviation of the reference voltage VREF is merely ±0.0085%), so that the reference voltage VREF has excellent effect again changing. FIG. 8 shows simulation diagram of curve family of reference voltage relative to output current according to embodiment of instant disclosure, and FIG. 8 is simulation diagram of the reference voltage relative to output current through scanning of the first system voltage VDD from 3 volt to 5 volt. FIG. 9 shows simulation diagram of curve family of the reference voltage relative to system voltage according to embodiment of instant disclosure, and FIG. 9 is simulation diagram for setting simulated ambient temperature between minus 55 degrees Celsius and 125 degrees Celsius. From the point of view of family curves, when the reference voltage VREF generated from the bandgap reference voltage generating circuit 200 faces change of ambient temperature, the loading resistor RL and the first system voltage VDD, the reference voltage VREF may be maintained at fixed voltage value (i.e. 1.48 volt) through operation mechanism of instant disclosure, wherein change of the loading resistor RL is corresponding to change of the output current IL.

Figure 10:
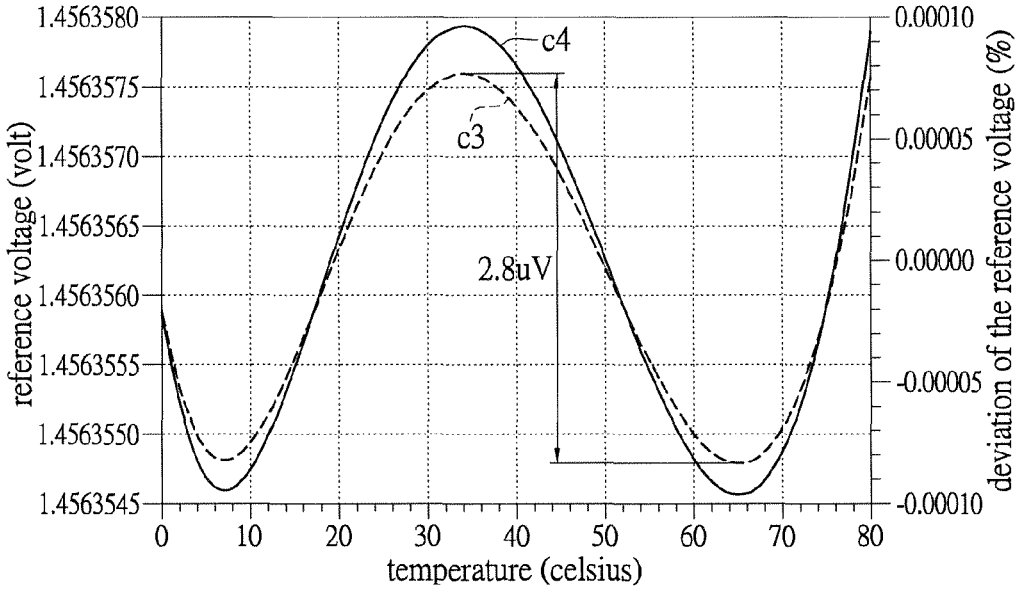
FIG. 10 shows curve view of reference voltage relative to temperature according to another embodiment of the instant disclosure.
Figure 11:
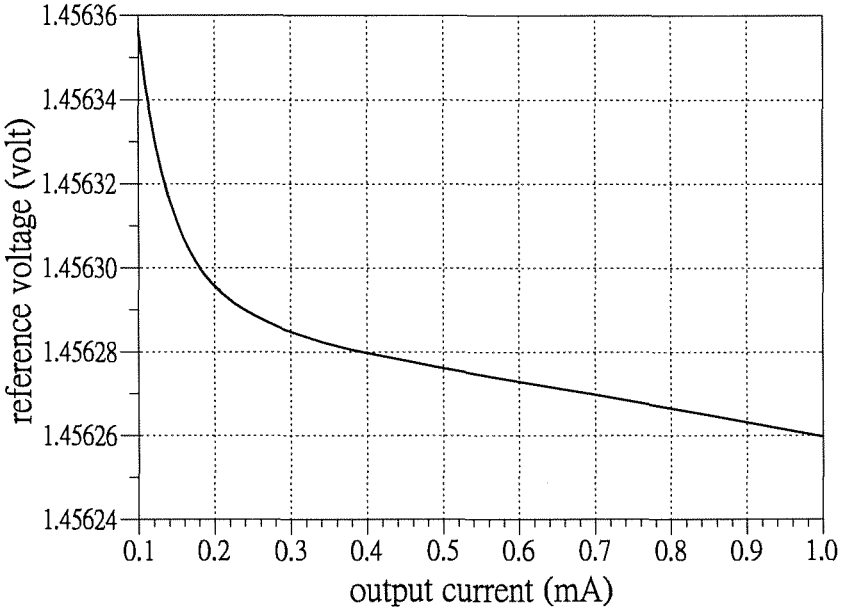
FIG. 11 shows curve view of the reference voltage relative to the output current according to another embodiment of the instant disclosure.
Figure 12:
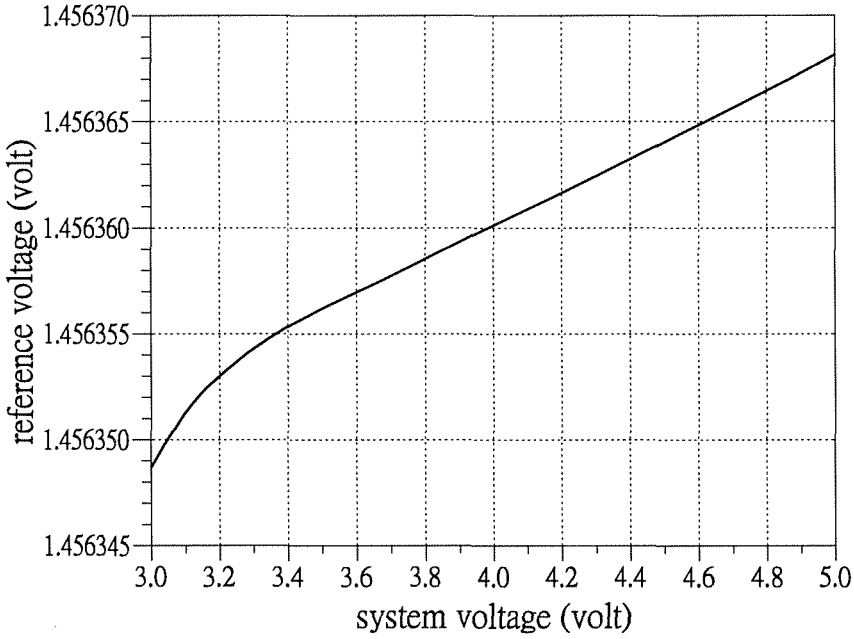
FIG. 12 shows curve view of the reference voltage relative to the system voltage according to another embodiment of the instant disclosure.
Figure 13:
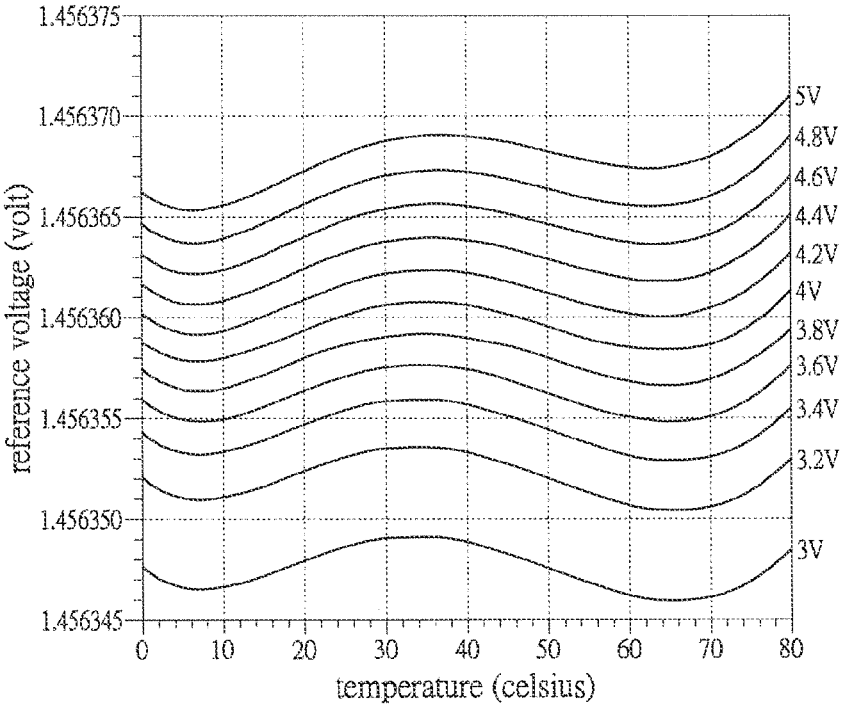
FIG. 13 shows simulation diagram of curve family of the reference voltage relative to temperature according to another embodiment of instant disclosure.
Figure 14:
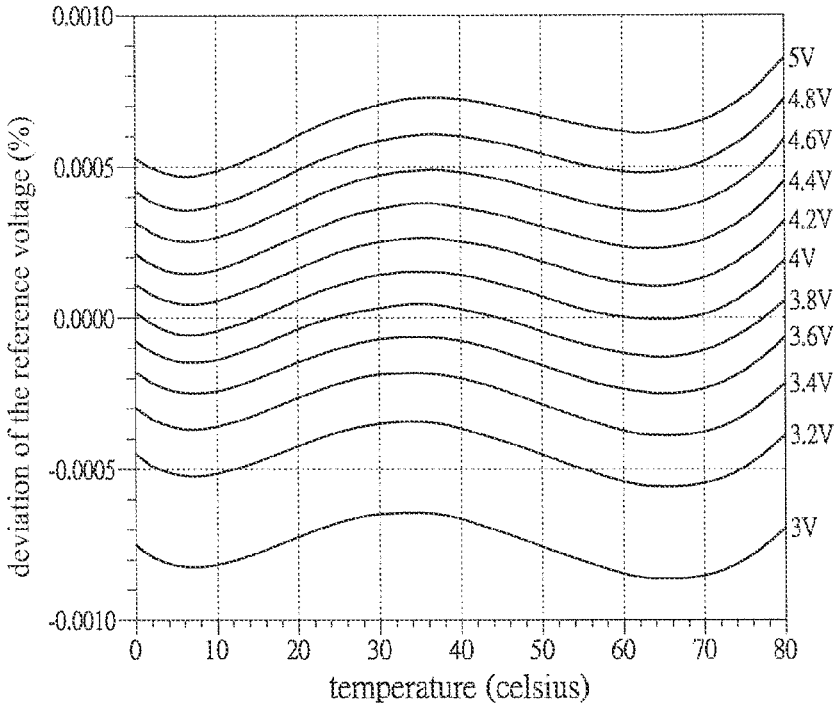
FIG. 14 shows simulation diagram of curve family of deviation of the reference voltage relative to temperature according to another embodiment of instant disclosure.
Figure 15:
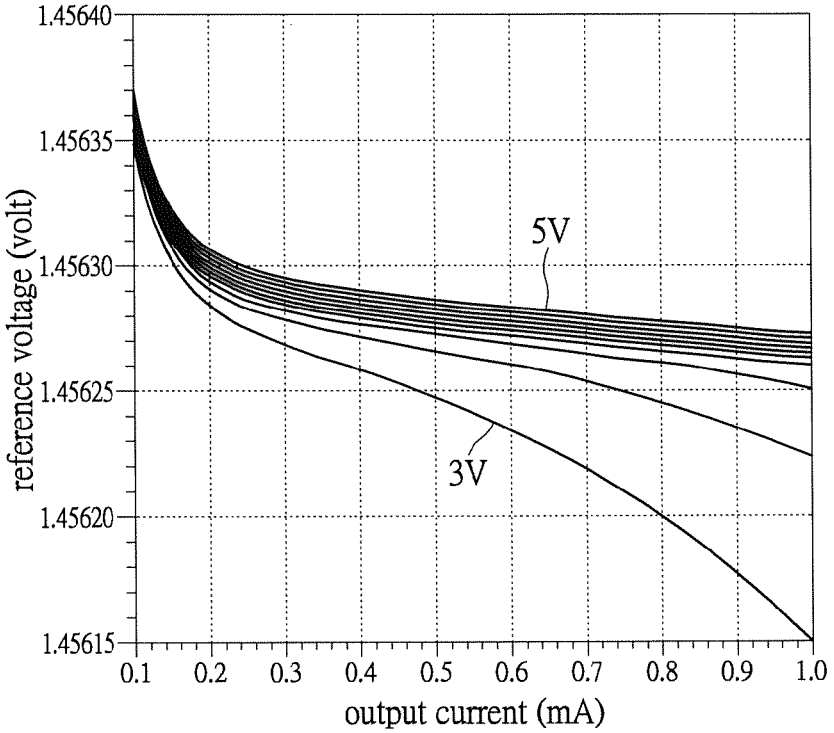
FIG. 15 shows simulation diagram of curve family of the reference voltage relative to the output current according to another embodiment of instant disclosure.
Figure 16:
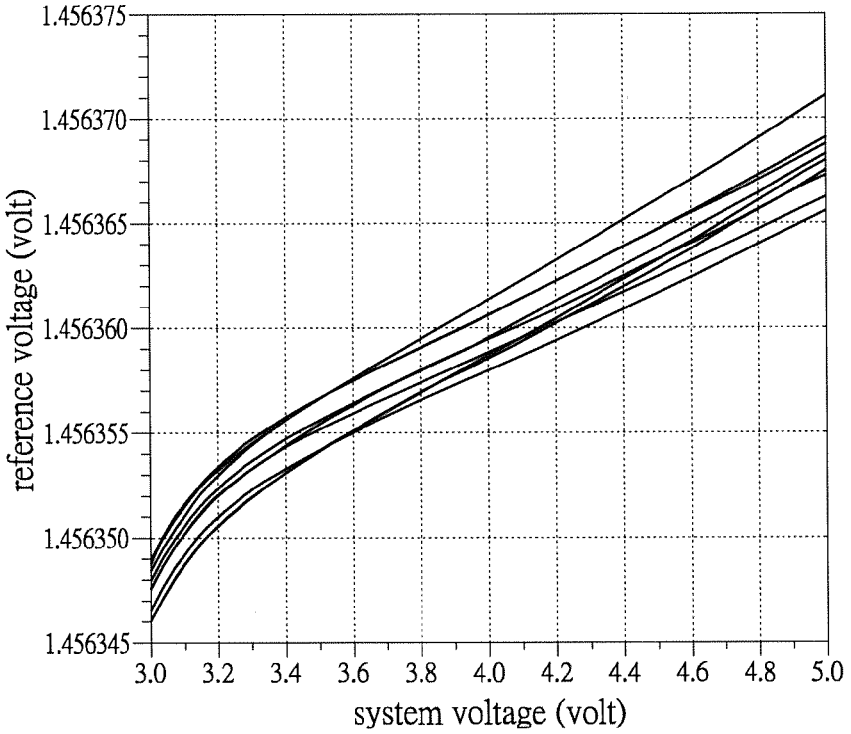
FIG. 16 shows simulation diagram of curve family of the reference voltage relative to the system voltage according to another embodiment of instant disclosure.

In another embodiment, the simulated ambient temperature is set between 0 degrees Celsius and 80 degrees Celsius for scanning the bandgap reference voltage generating circuit 200, reference voltage VREF provided by the bandgap reference voltage generating circuit 200 is more stable, relative to temperature change. Referring to FIG. 10, FIG. 10 shows curve view of reference voltage relative to temperature according to another embodiment of the instant disclosure. In FIG. 10, the horizontal axis represents the temperature (in ° C.), the left vertical axis represents the reference voltage (in volts) and the right vertical axis represents deviation of the reference voltage (in %), curve c3 represents the reference voltage VREF, and curve c4 represents deviation of the reference voltage VREF. In the present embodiment, difference between maximum and minimum of the reference voltage VREF is 2.8 microvolt; which means, deviation of Maximum and minimum of the reference voltage VREF is less than ±0.0001% from zero degrees Celsius to 80 degrees Celsius, so that it brings excellent temperature compensation effect. Afterwards, Referring to FIGS. 11 and 12, FIG. 11 shows curve view of the reference voltage relative to the output current according to another embodiment of the instant disclosure. FIG. 12 shows curve view of the reference voltage relative to the system voltage according to another embodiment of the instant disclosure. FIGS. 11 and 12 show that when the reference voltage VREF faces change of the output current and the system voltage VDD, the reference voltage VREF may be maintained a stable voltage value (e.g. 1.456 volt), wherein PSRR of the bandgap reference voltage generating circuit 200 can be improved to 100 dB (as shown in FIG. 12). From another point of view, referring to FIGS. 13-46, FIG. 13 shows simulation diagram of curve family of the reference voltage relative to temperature according to one embodiment of instant disclosure. FIG. 14 shows simulation diagram of curve family of deviation of the reference voltage relative to temperature according to one embodiment of instant disclosure. FIG. 15 shows simulation diagram of curve family of the reference voltage relative to the output current according to one embodiment of instant disclosure. FIG. 16 shows simulation diagram of curve family of the reference voltage relative to the system voltage according to one embodiment of instant disclosure. FIGS. 15-16 show that when the reference voltage VREF faces change of ambient temperature, the output current IL and the system voltage VDD, the bandgap reference voltage generating circuit 200 is able to provide a stable voltage value (e.g. 1.456 volt) and accordingly shows excellent stability.

In the following embodiments, there are only parts different from embodiments in FIG. 2 described, and the omitted parts are indicated to be identical to the embodiments in FIG. 2. In addition, for an easy instruction, similar reference numbers or symbols refer to elements alike.

[Another Embodiment of the Bandgap Reference Voltage Generating Circuit]

Figure 17:
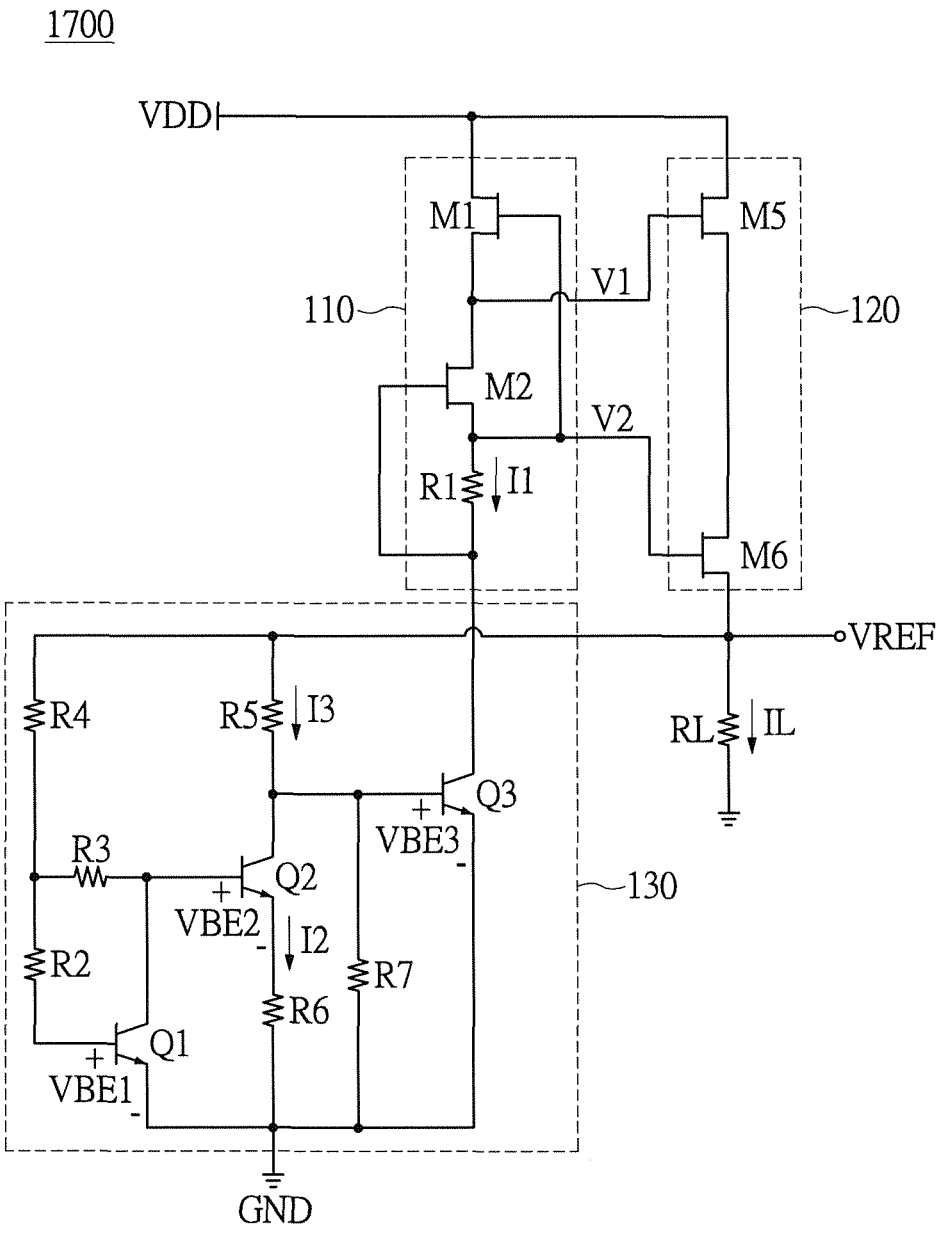
FIG. 17 shows detailed circuit diagram of the bandgap reference voltage generating circuit according to another embodiment of the instant disclosure.

Referring to FIG. 17, FIG. 17 shows detailed circuit diagram of the bandgap reference voltage generating circuit according to another embodiment of the instant disclosure. Difference form above-mentioned embodiment in FIG. 2 is that, bandgap reference voltage generating circuit 1700 of the present embodiment, regulator circuit 120 comprises a fifth transistor M5 and a sixth transistor M6. Drain of the fifth transistor M5 is connected to the first system voltage VDD, gate of the fifth transistor M5 is connected to source of the first transistor M1 for receiving the first voltage V1. Source voltage of the fifth transistor M5 is locked at a stable voltage value through the stable first voltage V1, and then the reference voltage VREF is independent of change of the first system voltage VDD and is locked at the first reference voltage value, wherein the first reference voltage value is equal to a sum of voltage-drop of the fifth resistor R5 and the third base-emitter voltage VBE3. Drain of the sixth transistor M6 is connected to source of the fifth transistor M5, gate of the sixth transistor M6 is connected to gate of the first transistor M1 for receiving the second voltage V2, source of the sixth transistor M6 is connected to one terminal of the loading resistor RL and the fifth resistor R5 and outputs the reference voltage VREF, wherein the fifth transistor M5 and the sixth transistor M6 are depletion mode transistors.

In the present embodiment, when the first system voltage VDD is larger than the threshold voltage value (e.g. 3 volt), gate voltage and source voltage of the first transistor M1 may be respectively locked at stable voltage value and gate voltage and source voltage of the second transistor M2 may also be maintained at stable voltage value respectively. Next, the first current I1 may be generated via the first resistor R1. Moreover, gate of the fifth transistor M5 is connected to source of the first transistor M1 to be served as the first voltage V1, and gate of the sixth transistor M6 is connected to source of the second transistor M2 to be served as the second voltage V2. The bandgap reference voltage generating circuit 1700 utilizes the first voltage V1 (i.e. source voltage of the first transistor M1) and the second voltage V2 (i.e. source voltage of the second transistor M2) to drive or bias the regulator circuit 120. Furthermore, because gate of the fifth transistor M5 receives source voltage of the first transistor M1 to be served as the first voltage V1 and the fifth transistor M5 itself is depletion mode transistor, source voltage of the fifth transistor M5 is larger than the first voltage V1 (about 1 volt), and then source voltage of the fifth transistor M5 may be locked at a voltage value which is a sum of the first voltage V1 and 1 volt, wherein drain voltage of the sixth transistor M6 is equal to source voltage of the fifth transistor M5. Afterwards, because gate voltage and source voltage of the sixth transistor M6 is locked, source voltage of the sixth transistor M6 (i.e. reference voltage VREF) is also locked at a fixed voltage value.

In the aspect of the temperature compensation effect, difference from above-mentioned embodiment of FIG. 2 is that the temperature-compensating circuit 130 further comprises a seventh resistor R7. One terminal of the seventh resistor R7 is connected to base of the third bipolar transistor Q3, another terminal of the seventh resistor R7 is connected to the ground voltage GND. In the present embodiment, the seventh resistor R7 is used for elevating the reference voltage VREF from the first reference voltage value (e.g. 1.48 volt) to the second reference voltage value (e.g. 2.78 volt), wherein the second reference voltage value is a sum of voltage-drop of the fifth resistor R5 and voltage-drop of the seventh resistor R7. Regarding relevant operation mechanism of the present embodiment, it is identical to the embodiment in FIG. 2, and it is not repeated thereto.

Figure 18:
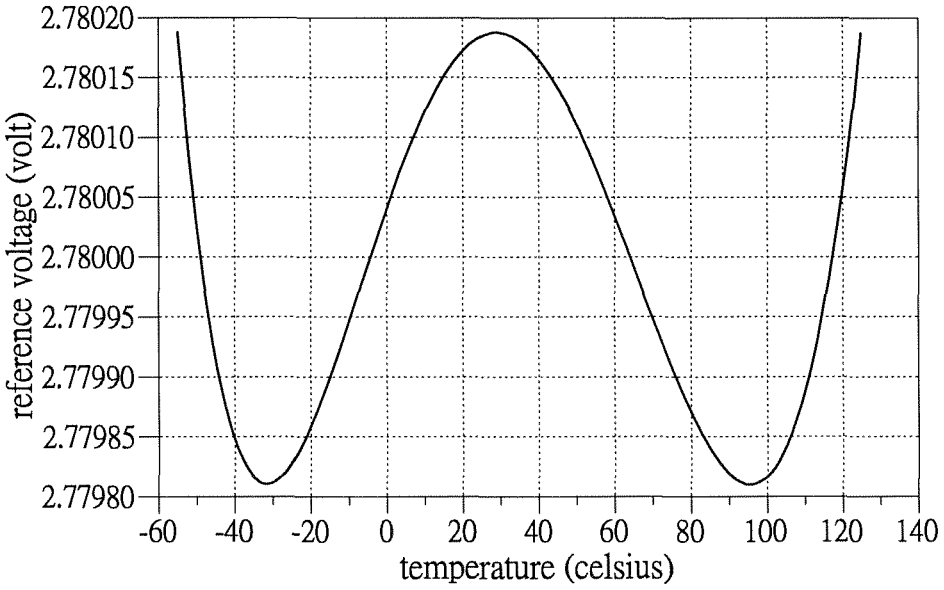
FIG. 18 shows simulation curve view of the reference voltage relative to temperature according to another embodiment of the instant disclosure.
Figure 19:
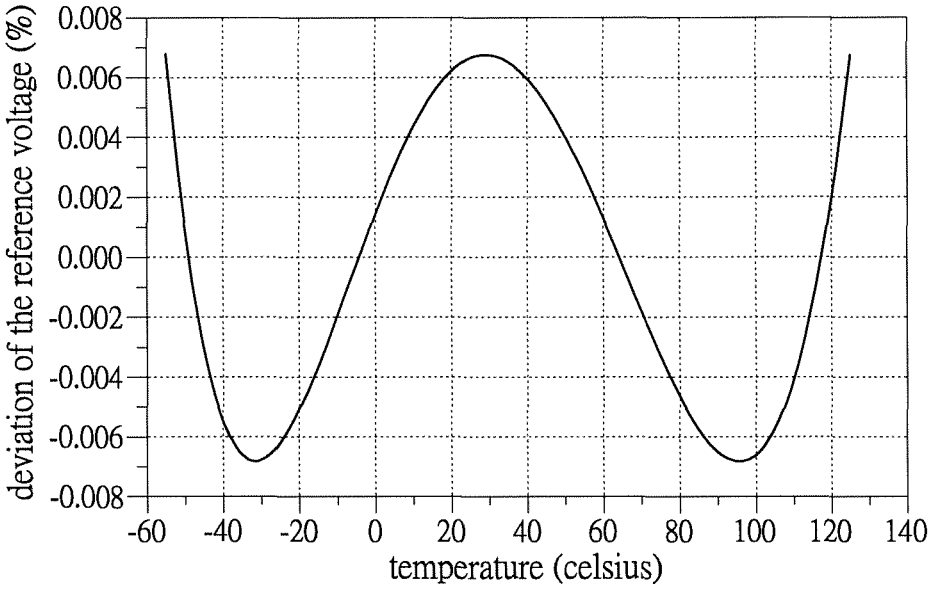
FIG. 19 shows simulation curve view of deviation of the reference voltage relative to temperature according to another embodiment of the instant disclosure.
Figure 20:
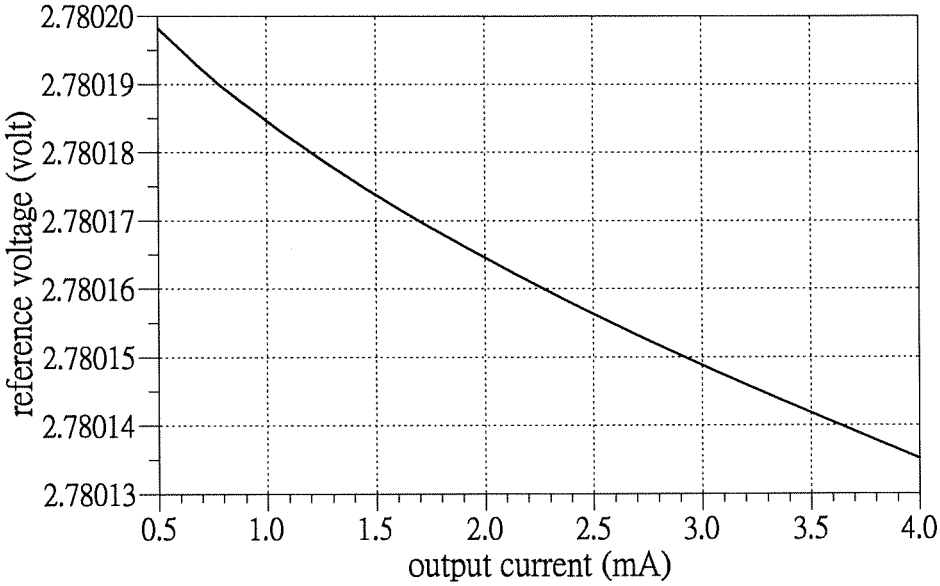
FIG. 20 shows simulation curve view of reference voltage relative to output current according to another embodiment of the instant disclosure.
Figure 21:
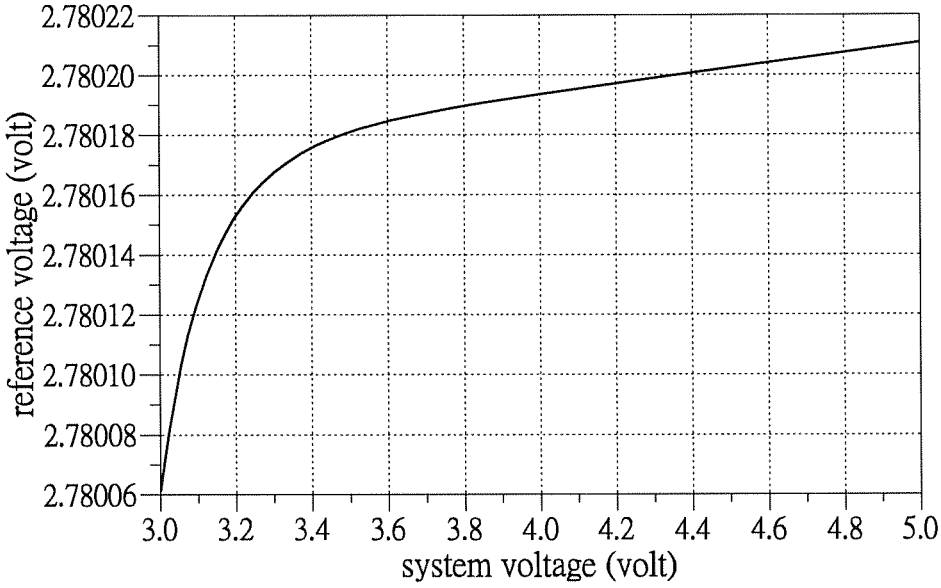
FIG. 21 shows simulation curve view of the reference voltage relative to the system voltage according to another embodiment of the instant disclosure.
Figure 22:
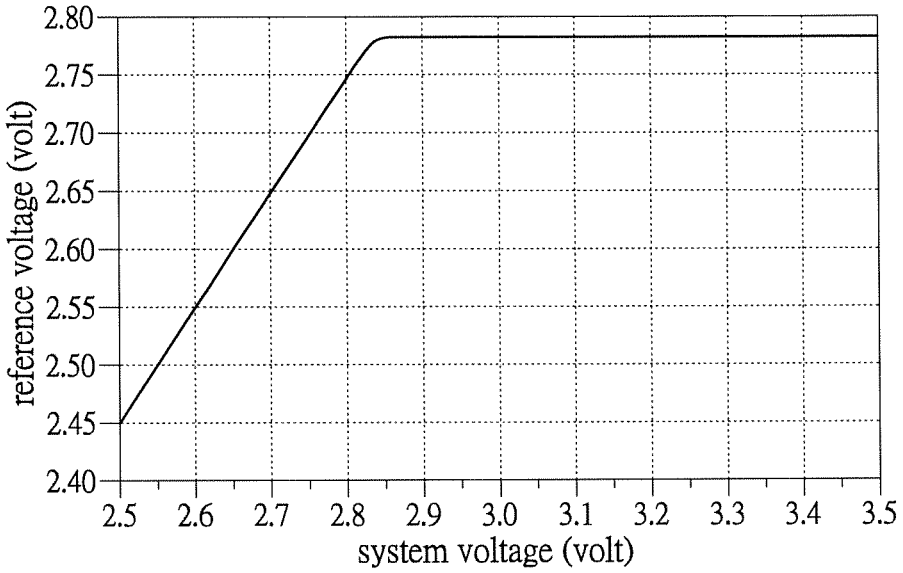
FIG. 22 shows another simulation curve view of the reference voltage relative to the system voltage according to another embodiment of the instant disclosure.

Referring to FIGS. 17, 18 and 19, FIG. 18 shows simulation curve view of the reference voltage relative to temperature according to another embodiment of the instant disclosure. FIG. 19 shows simulation curve view of deviation of the reference voltage relative to temperature according to another embodiment of the instant disclosure. When temperature changes between minus 55 degrees Celsius and 125 degrees Celsius, the temperature curve of the reference voltage shows an excellent third-order temperature curve, and deviation of the reference voltage is less than ±0.0067%. Referring to FIGS. 20 and 21, FIG. 20 shows simulation curve view of reference voltage relative to output current according to another embodiment of the instant disclosure. FIG. 21 shows simulation curve view of the reference voltage relative to the system voltage according to another embodiment of the instant disclosure. FIGS. 20 and 21 shows that the reference voltage VREF provided by the bandgap reference voltage generating circuit 1700 may be maintained at the stable second reference voltage value (e.g. 2.78 volt) in face of change of the output current IL and the system voltage VDD. Referring to FIG. 22, FIG. 22 shows another simulation curve view of the reference voltage relative to the system voltage according to another embodiment of the instant disclosure. FIG. 22 shows that scanning of the system voltage changes from 2.5 volt to 3.5 volt, when the system voltage is about 2.85 volt, the reference voltage VREF starts to enter in the stable first reference voltage value (e.g. 2.78 volt) and the first reference voltage value (e.g. 2.78 volt) is maintained.

[One Embodiment of the Electronic System]

Figure 23:
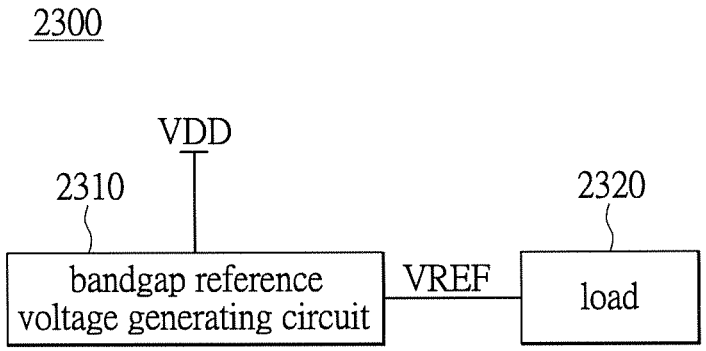
FIG. 23 shows a schematic diagram of the electronic system according to embodiment of the instant disclosure.

Referring to FIG. 23, FIG. 23 shows a schematic diagram of the electronic system according to embodiment of the instant disclosure. The electronic system 2300 comprises a bandgap reference voltage generating circuit 2310 and a load 2320. The load 2320 is connected to bandgap reference voltage generating circuit 2310. The bandgap reference voltage generating circuit 2310 may be one of bandgap reference voltage generating circuit 200 or 1700 in the former embodiments, providing a reference voltage VREF to the load 2320 or next-stage circuit. The electronic system 2300 may be a system in various kinds of electronic devices such as hand-held devices or portable devices.

In summary, the bandgap reference voltage generating circuit and the electronic system provided by the instant disclosure is able to provide the reference voltage independent of the battery voltage and ambient temperature (i.e. two variables) when the bandgap reference voltage generating circuit faces change of the battery voltage (i.e. voltage value of the battery voltage) and ambient temperature (i.e. minus 50 degrees Celsius to 120 degrees Celsius).

In at least one of the embodiments of the instant disclosure, the bandgap reference voltage generating circuit is able to provide the reference voltage steadily when the bandgap reference voltage generating circuit face change of the loading resistor (corresponding to different output current).

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A bandgap reference voltage generating circuit, used for providing a reference voltage, the bandgap reference voltage generating circuit, comprising:

a four-terminal current source circuit, electrically connected to a first system voltage, wherein when the first system voltage is larger than a threshold voltage value, a first voltage, a second voltage and a first current outputted from the four-terminal current source circuit are independent of variation of the first system voltage;

a regulator circuit, electrically connected to the four-terminal current source circuit, wherein when the regulator circuit receives the first voltage and the second voltage, and when the first system voltage is larger than the threshold voltage value, the reference voltage outputted from the regulator circuit is independent of variation of the first system voltage via voltage difference steadily between the first voltage and the second voltage; and a temperature-compensating circuit, electrically connected to the four-terminal current source circuit and the regulator circuit, wherein the temperature-compensating circuit receives the first current and compensates a temperature curve of the reference voltage outputted from the regulator circuit.

2. The bandgap reference voltage generating circuit according to claim 1, wherein temperature curve of the reference voltage outputted from the regulator circuit is compensated, so that temperature curve of the reference voltage is compensated from second-order temperature curve to third-order temperature curve.

3. The bandgap reference voltage generating circuit according to claim 1, wherein when the first system voltage is larger than the threshold voltage value, the four-terminal current source circuit outputs the first voltage and the second voltage steadily and outputs the first current steadily.

4. The bandgap reference voltage generating circuit according to claim 1, wherein the four-terminal current source circuit comprising:

a first transistor, having a drain connected to the first system voltage;

a second transistor, having a drain connected to a source of the first transistor, having a source connected to a gate of the first transistor, wherein the first transistor and the second transistor are depletion mode transistors; and a first resistor, having one terminal connected to the source of the second transistor, having another terminal connected to the gate of the second transistor, wherein when the first system voltage is larger than the threshold voltage value, the first current generated from the first transistor, the second transistor and the first resistor is steady current independent of variation of the first system voltage.

5. The bandgap reference voltage generating circuit according to claim 4, the regulator circuit comprising:

a third transistor, having a drain connected to the first system voltage, having a gate connected to the gate of the first transistor for receiving the first voltage; and a fourth transistor, having a drain connected a source of the third transistor, having a gate connected to another terminal of the first resistor for receiving the second voltage, having a source connected to a loading resistor and outputting the reference voltage, wherein the third transistor and the fourth transistor are depletion mode transistors, wherein a source voltage of the third transistor is stabilized via the first voltage, so that the reference voltage is independent of variation of the first system voltage and be locked in a first reference voltage value.

6. The bandgap reference voltage generating circuit according to claim 4, the regulator circuit comprising:

a fifth transistor, having a drain connected to the first system voltage, having a gate connected to the source of the first transistor for receiving the first voltage; and a sixth transistor, having a drain connected to a source of the fifth transistor, having a gate connected to the gate of the first transistor for receiving the second voltage, having a source connected to a loading resistor and outputting the reference voltage, wherein the fifth transistor and the sixth transistor are depletion mode transistors and source voltage of the fifth transistor is locked at steady voltage value via the first voltage steadily, so that the reference voltage is independent of variation of the first system voltage and is locked at a first reference voltage value.

7. The bandgap reference voltage generating circuit according to claim 5, the temperature-compensating circuit comprising:

a first bipolar transistor, having a emitter connected to a ground voltage;

a second resistor, having one terminal connected to a base of the first bipolar transistor;

a third resistor, having one terminal connected to another terminal of the second resistor, having another terminal connected to a collector of the first bipolar transistor;

a fourth resistor, having one terminal connected to one terminal of the third resistor;

a fifth resistor, having one terminal connected to another terminal of the fourth resistor and connected to the source of the fourth transistor or the sixth transistor;

a second bipolar transistor, having a base connected to another terminal of the third resistor, having a collector connected to another terminal of the fifth resistor;

a sixth resistor, having one terminal connected to an emitter of the second bipolar transistor, having another terminal connected to the ground voltage, wherein a second current flowing through the sixth resistor is a current with positive temperature coefficient via a base-emitter voltage difference between a first base-emitter voltage of the first bipolar transistor and a second base-emitter voltage of the second bipolar transistor; and a third bipolar transistor, having a base connected to the collector of the second bipolar transistor, having an emitter connected to the ground voltage, having a collector connected to another terminal of the first resistor, wherein the third bipolar transistor has a third base-emitter voltage with negative temperature coefficient, the reference voltage is equal to or close to a voltage with zero temperature coefficient via adjustment of resistor value of the fifth resistor and the sixth resistor, and the first reference voltage value is equal to a sum of a voltage-drop of the fifth resistor and the third base-emitter voltage.

8. The bandgap reference voltage generating circuit according to claim 6, the temperature-compensating circuit comprising:

a first bipolar transistor, having a emitter connected to a ground voltage;

a second resistor, having one terminal connected to a base of the first bipolar transistor;

a third resistor, having one terminal connected to another terminal of the second resistor, having another terminal connected to a collector of the first bipolar transistor;

a fourth resistor, having one terminal connected to one terminal of the third resistor;

a fifth resistor, having one terminal connected another terminal of the fourth resistor and connected to the source of the fourth transistor or the sixth transistor;

a second bipolar transistor, having a base connected to another terminal of the third resistor, having a collector connected to another terminal of the fifth resistor;

a sixth resistor, having one terminal connected to an emitter of the second bipolar transistor, having another terminal connected to the ground voltage, wherein a second current flowing through the sixth resistor is a current with positive temperature coefficient via a base-emitter voltage difference between a first base-emitter voltage of the first bipolar transistor and a second base-emitter voltage of the second bipolar transistor; and a third bipolar transistor, having a base connected to the collector of the second bipolar transistor, having an emitter connected to the ground voltage, having a collector connected to another terminal of the first resistor, wherein the third bipolar transistor has a third base-emitter voltage with negative temperature coefficient, the reference voltage is equal to or close to a voltage with zero temperature coefficient via adjustment of resistor value of the fifth resistor and the sixth resistor, and the first reference voltage value is equal to a sum of a voltage-drop of the fifth resistor and the third base-emitter voltage.

9. The bandgap reference voltage generating circuit according to claim 7, wherein the temperature curve of the reference voltage is compensated from second-order temperature curve to third-order temperature curve via adjustment of resistor value of the second resistor and the third resistor.

10. The bandgap reference voltage generating circuit according to claim 8, wherein the temperature curve of the reference voltage is compensated from second-order temperature curve to third-order temperature curve via adjustment of resistor value of the second resistor and the third resistor.

11. The bandgap reference voltage generating circuit according to claim 7, the temperature-compensating circuit further comprising:

a seventh resistor, having one terminal connected to the base of the third bipolar transistor, having another terminal connected to the ground voltage, wherein the seventh resistor is configured for increasing the first reference voltage value of the reference voltage to the second reference voltage value, and the second reference voltage value of the reference voltage is equal to a sum of voltage-drop of the fifth resistor and voltage-drop of the seventh resistor.

12. The bandgap reference voltage generating circuit according to claim 8, the temperature-compensating circuit further comprising:

a seventh resistor, having one terminal connected to the base of the third bipolar transistor, having another terminal connected to the ground voltage, wherein the seventh resistor is configured for increasing the first reference voltage value of the reference voltage to the second reference voltage value, and the second reference voltage value of the reference voltage is equal to a sum of voltage-drop of the fifth resistor and voltage-drop of the seventh resistor.

13. An electronic system, comprising:

a bandgap reference voltage generating circuit, electrically connected to a first reference voltage, the bandgap reference voltage generating circuit comprising:

a four-terminal current source circuit, electrically connected to a first system voltage, wherein when the first system voltage is larger than a threshold voltage value, a first voltage, a second voltage and a first current outputted from the four-terminal current source circuit are independent of variation of the first system voltage;

a regulator circuit, electrically connected to the four-terminal current source circuit, wherein when the regulator circuit receives the first voltage and the second voltage and when the first system voltage is larger than the threshold voltage value, the reference voltage outputted from the regulator circuit is independent of variation of the first system voltage via voltage difference steadily between the first voltage and the second voltage; and a temperature-compensating circuit, electrically connected to the four-terminal current source circuit and the regulator circuit, wherein the temperature-compensating circuit receives the first current and compensates temperature curve of the reference voltage outputted from the regulator circuit; and a load, electrically connected to the bandgap reference voltage generating circuit for receiving the reference voltage.

* * * * *